US007642447B2

(12) United States Patent
Kojima

(10) Patent No.: US 7,642,447 B2
(45) Date of Patent: Jan. 5, 2010

(54) ELECTRONIC MUSICAL INSTRUMENT SYSTEM AND METHOD EMULATING A REMOVABLE MEDIA DRIVE

(75) Inventor: Shoichi Kojima, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 11/411,011

(22) Filed: Apr. 25, 2006

(65) Prior Publication Data

US 2006/0254410 A1 Nov. 16, 2006

(30) Foreign Application Priority Data

Apr. 26, 2005 (JP) ..... 2005-127885

(51) Int. Cl.
*G10H 7/00* (2006.01)

(52) U.S. Cl. ..... 84/645; 84/609

(58) Field of Classification Search ..... 84/645, 84/609

See application file for complete search history.

(56) References Cited

U.S. PATENT DOCUMENTS 5,397,853 A * 3/1995 Koguchi ..... 434/307 A
6,356,971 B1 * 3/2002 Katz et al. ..... 710/301
6,534,701 B2 * 3/2003 Isozaki ..... 84/609
2001/0037719 A1 * 11/2001 Gardner et al. ..... 84/478
2001/0044747 A1 * 11/2001 Ramachandran et al. ..... 705/16

OTHER PUBLICATIONS

Alcohol Software Description. Apr. 20, 2005. < http://web.archive.org/web/20050420003006/trial.alcohol-soft.com/en/alcohol_info.php >.*

Alcohol Software Description. Jul. 3, 2004. < http://web.archive.org/web/20040703113632/http://trial.alcohol-soft.com/en/alcohol_info.php >.*

* cited by examiner

*Primary Examiner*—Jeffrey Donels
*Assistant Examiner*—Andrew R Millikin
(74) *Attorney, Agent, or Firm*—Foley & Lardner LLP

(57) ABSTRACT

An electronic musical instrument comprising a CPU, a display device, operators, a data interface, and a storage device storing music tone data, all interconnected via a bus line, wherein upon an inquiry from a PC connected to the data interface for a device identity, the electronic music instrument transmits via the data interface the device identity of a removable media drive. In some embodiments, wherein upon commands sent from the PC, the electronic musical instrument transmits the stored music tone data in a format consistent with the removable media drive. An electronic music system comprising such an electronic musical instrument connected to a PC via a data interface. A method of data communication between an electronic music instrument and a PC.

40 Claims, 7 Drawing Sheets

PROCESSING IN THE ELECTRONIC MUSICAL INSTRUMENT (a)

(b)

PERFORMANCE DATA

| TIME (TICK) | MIDI MESSAGE |
|---|---|
| 0 | PROGRAM CHANGE |
| 0 | NOTE ON |
| 24 | NOTE ON |
| 1 | NOTE OFF |
| ⋮ | ⋮ |

FIG. 6

ELECTRONIC MUSICAL INSTRUMENT SYSTEM AND METHOD EMULATING A REMOVABLE MEDIA DRIVE

CROSS-REFERENCE TO RELATED PATENT APPLICATIONS

The present invention relates to Japanese patent applications No. 2005-127885 (filed on Apr. 26, 2005), which was assigned to the assignee of the present invention, which is incorporated herein by reference in its entirety and from which priority is claimed for the present invention.

BACKGROUND OF THE INVENTION

The present invention relates to an electronic musical instrument and, in particular, it relates to an electronic musical instrument that can be connected to a personal computer and that provides musical tone data.

For some time, electronic musical instruments have been used to transmit or receive performance data that comply with the MIDI (Musical Instrument Digital Interface) standard to or from a personal computer (hereinafter "PC"). An electronic musical instrument system in which an electronic musical instrument and a PC are connected with mutual control by a communications format that complies with the MIDI standard is disclosed in Japanese Patent Publication Number 3460230.

However, the electronic musical instrument system disclosed in that reference is configured such that the system supports MIDI commands for the control of the electronic musical instrument. Accordingly, in order for control to be carried out by the PC, it is necessary for the PC to have installed and execute software capable of controlling the electronic musical instrument. On the other hand, typically software is already installed in the PC that controls reproduction systems for media such as CD (compact disk) or DVD (digital versatile disk) and the like, which reproduces musical tones and images. That kind of software enables not only the reproduction of the media by the PC, but also makes it possible to change the order in which the tunes are arranged, create new media on which only some of the selected tunes are recorded, record to a different media (for example, from a CD to a MiniDisk), or convert and store to a different format (for example, from a CD to a MP3 format).

Accordingly, when a user desires to reproduce a CD, the software that reproduces CDs must be launched. In addition, if the user also desires to control the electronic musical instrument contemporaneously, the software that controls the electronic musical instrument must also be launched. Hence this creates a problem that the operation of the PC becomes more complicated.

Embodiments of the present invention are aimed to solve the problem discussed above and provides an electronic musical instrument with which there is no need for settings that generate the control data unique to the electronic musical instrument in the external devices such as personal computers (PC), hence enabling easier use.

SUMMARY OF THE DISCLOSURE

In order to achieve this object, an electronic musical instrument according to a first preferred embodiment comprises storage means for storing performance data that correspond to time information, musical tone generation means for generating musical tone data in conformance with the performance data, automatic performance means for reading out the performance data stored in the storage means at a time in conformance with the time information and for supplying the performance data to the tone generation means, communications means for communicating with external devices, input means, control means, and transmission means for transmitting the musical tone data generated by the musical tone generation means via the communications means. In this embodiment, the input mean inputs control data, wherein the control data requests the musical tone data via the communications means from a media on which the musical tone data have been stored such that the music tone data are reproduced, and wherein the stored music tone data is sampled at a specified sampling frequency. Furthermore, the control means controls the musical tone generation means in conformance with the control data input in the input means, in accordance with the performance data stored in the storage means, and by means of the automatic performance means, in the generation of the musical tone data.

With the electronic music instrument of the first embodiment, even if the external device transmits control data that request musical tone data stored at a specified sampling frequency on the media, it is possible to carry out such request. Accordingly, there is the advantageous result that settings that generate control data unique to the electronic musical instrument are not necessary in the external device and therefore use is convenient.

In a second preferred embodiment, the electronic musical instrument of the first embodiment is one in which the automatic performance means forms image data based on the performance data, and the transmission means outputs the image data formed by the automatic performance means and the music tone data formed by the music tone generation means via the communications means.

In addition to the advantages of the first embodiment, the second preferred embodiment has the additional advantageous result that it is possible to supply image data from the electronic musical instrument.

In yet a third preferred embodiment, the electronic musical instrument of the second embodiment is one in which the automatic performance means forms image data to display a musical score based on the performance data stored in the storage means.

In addition to the advantages of the first and second embodiments, the third preferred embodiment has the additional advantageous result that it is possible to display the musical score on an external device.

In yet a fourth preferred embodiment, the electronic musical instrument of the second or third embodiment is one in which the storage means stores lyrics, and the automatic performance means forms the image data that displays the lyrics stored in the storage means.

In addition to the advantages of the first, second, and third embodiments, the third preferred embodiment has the additional advantageous result that it is possible to display the lyrics on an external device.

BRIEF DESCRIPTION OF THE DRAWINGS

FIG. 2(*a*) illustrates a display screen when the composition title is displayed in conformance with the track number, and FIG. 2(*b*) illustrate a display screen when a performance has been started and the musical score is displayed;

FIG. 6 is a table that shows performance data; and

DETAILED DESCRIPTION OF PREFERRED EMBODIMENTS

Figure 1:
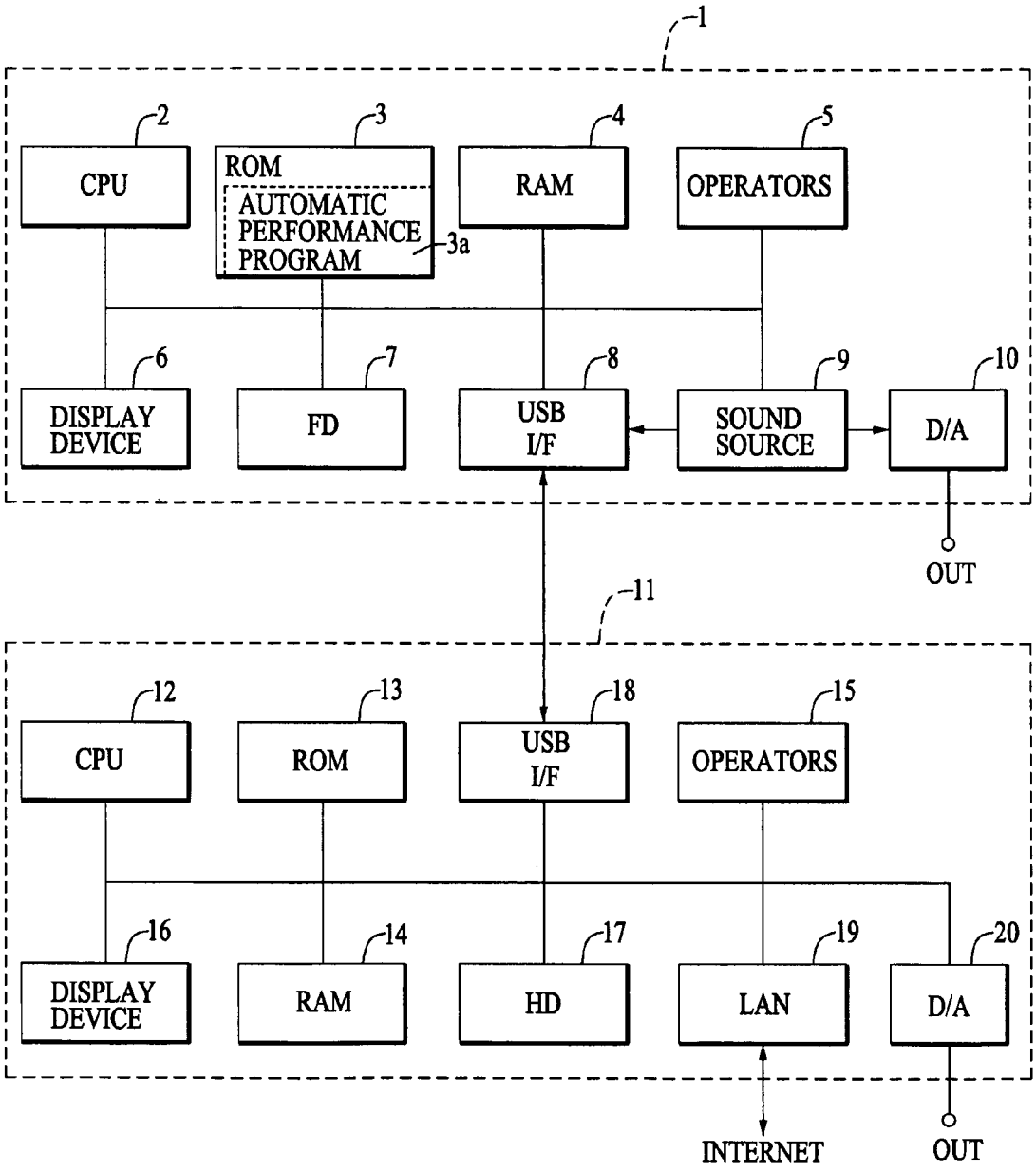
FIG. 1 is a block diagram illustrating an electrical configuration of an electronic musical instrument and a personal computer in one preferred embodiment of the present invention.

An explanation will be given below regarding preferred embodiments of the present invention while referring to the attached drawings. FIG. 1 is a block diagram that shows the electrical configuration of the electronic musical instrument 1 and the personal computer (PC) 11. In one preferred embodiment, the PC 11 is connected to the electronic musical instrument 1 by a communications circuit that carries out communications.

The electronic musical instrument 1 comprises a CPU 2, ROM 3, RAM 4, operators 5, a display device 6, a flexible disk system 7, an USB interface 8, and a sound source 9, all mutually interconnected by a bus line. The output of the sound source 9 is connected to both an USB interface 8 and a D/A converter 10.

The CPU 2 is a processing unit. The ROM 3 stores various kinds of control programs such as an automatic performance program 3*a* and the like, which are executed by the CPU 2, as well as fixed value data that are referred to at the time of program execution. The RAM 4 is a rewritable memory for the temporary storage of the various kinds of programs or data and the like during the execution of programs such as the control programs stored in the ROM 3.

The operators 5 comprise various kinds of rotating controls and switches. The user controls the starting and stopping of the automatic performance and the like through operating of the operators 5. The display device 6 comprises an LCD (a liquid crystal display), and displays the title of the selected composition, the selected tempo value, and various other information at the time that an automatic performance is carried out.

The flexible disk system 7 comprises a flexible disk mounted such that the disk is freely removable. The flexible disk system 7 enables the reading out of the automatic performance data stored on the flexible disk as well as the writing of new automatic performance data to the flexible disk. In this preferred embodiment, the format of the automatic performance data stored on the flexible disk is known as SMF (Standard MIDI File) format. SMF is a standard file format with which performance data are stored in accordance with the MIDI standard. It is possible for a performance to be carried out with a different sequencer or sequence software and information such as the title and the like of each composition to be stored in the lead portion. In other embodiments, data formats other than the SMF format can be used.

The USB interface 8 is an input/output interface that complies with a standard known as USB (Universal Serial Bus). The USB interface 8 enables communications with a personal computer 11 and various types of external devices. The sound source 9 forms musical tone data having a specified pitch, amplitude, and timbre in conformance with the MIDI data sent from the CPU 2 that instructs the starting and stopping of the sound generation. In this embodiment, the musical tone data are a PCM signal having a sampling frequency of 44.1 KHz and a quantizing bit count of 16.

The musical tone data formed by the sound source 9 are output to the USB interface 8 and the D/A converter 10. The musical tone data output to the USB interface 8 are transmitted to the PC 11 via the USB interface, and said music tone data are in the same format as the musical tone data transmitted by a CD reproduction system (a CD drive) of the PC 11. The musical tone data that have been input to the D/A converter 10 are converted into an analog signal, amplified by an amplifier (not shown), and emitted from a speaker (not shown).

The PC 11 is a personal computer that comprises a CPU 12, ROM 13, RAM 14, operators 15, a display device 16, a hard disk 17, an USB interface 18, a LAN interface 19, and a D/A converter 20, all mutually interconnected by a bus line.

The CPU 12 is a processing unit. The ROM 13 stores various kinds of control programs, which are executed by the CPU 12, as well as fixed value data that are referred to at the time of program execution. The RAM 14 is a rewritable memory used to temporarily store data and application programs when the CPU 12 executes application programs stored on the hard disk 17 and the like.

The operators 15 may comprise a keyboard for carrying out input operations and a pointing device such as a mouse. The display device 16 can be a CRT, an LCD, or any other suitable display devices.

The hard disk 17 stores the application programs that control the reproduction systems that reproduces media such as CDs, DVDs, and the like, such as CD or DVD drives. The hard disk 17 also stores the musical tone data and the like that have been input via the USB interface 18.

The USB interface 18 of the PC 11 is similar to the USB interface 8 of the electronic musical instrument 1. The USB interface 18 is an interface that complies with the USB standard, and can be used to connect to various external devices. The LAN interface 19 is an interface that is used for connection to the internet, via a LAN (local area network) or via a modem and the like. During the execution of application programs by the PC 11 for the reproduction of a CD, based on the TOC (table of contents) of the CD, the PC 11 can access a CD database via the Internet to acquire information such as the composition title and the like.

The TOC is configured with the each of the track numbers of the plurality of compositions stored on the CD and by the corresponding performance start time, which is the time at which the performance of each track starts. The CD database accessible via the internet stores the track numbers and the performance start times for substantially every CD on the market; hence when the TOC of the CD is input to the database in a query, it is possible to search for and specify the composition of the CD based on the TOC. Information such as the composition title, the singer, the composer, the lyricist of each track is stored for each CD in the CD database, and this information can be acquired by the PC 11.

The D/A converter 20 converts digital signals to analog signals. The converter reads out the audio signal transmitted via the USB interface or the audio data stored on the hard disk 17 and converts this into an analog signal that is amplified by an amplifier (not shown) and is emitted by a speaker (not shown).

Figure 2A:
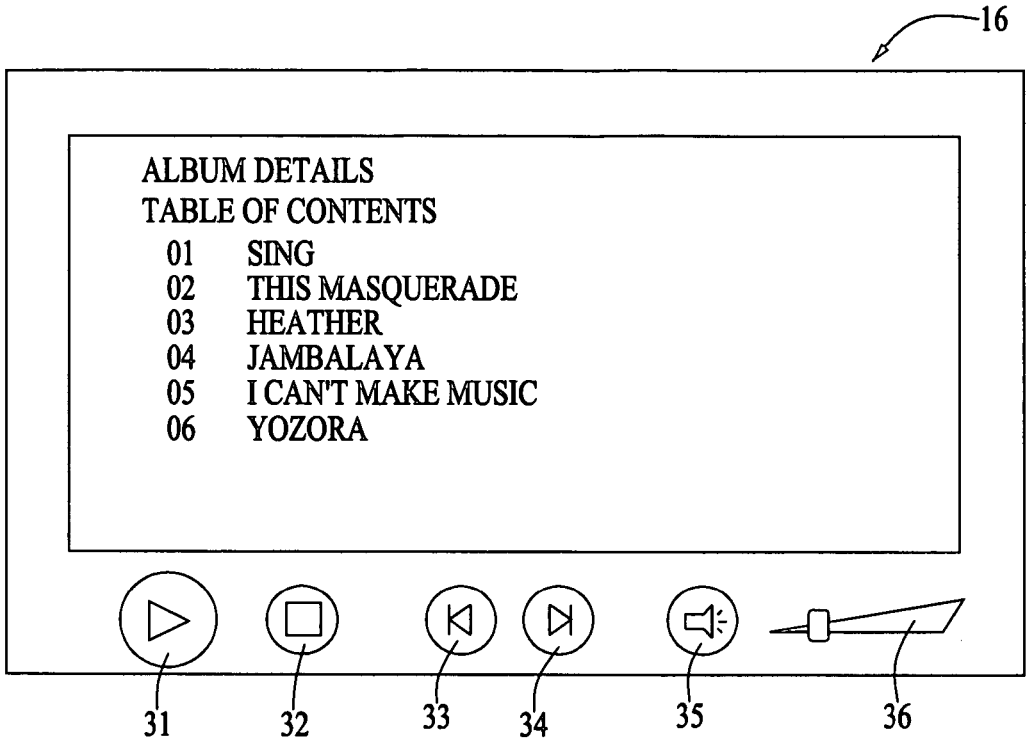
FIG. 2 illustrates a display screen displayed on a display device of a personal computer.
Figure 2B:
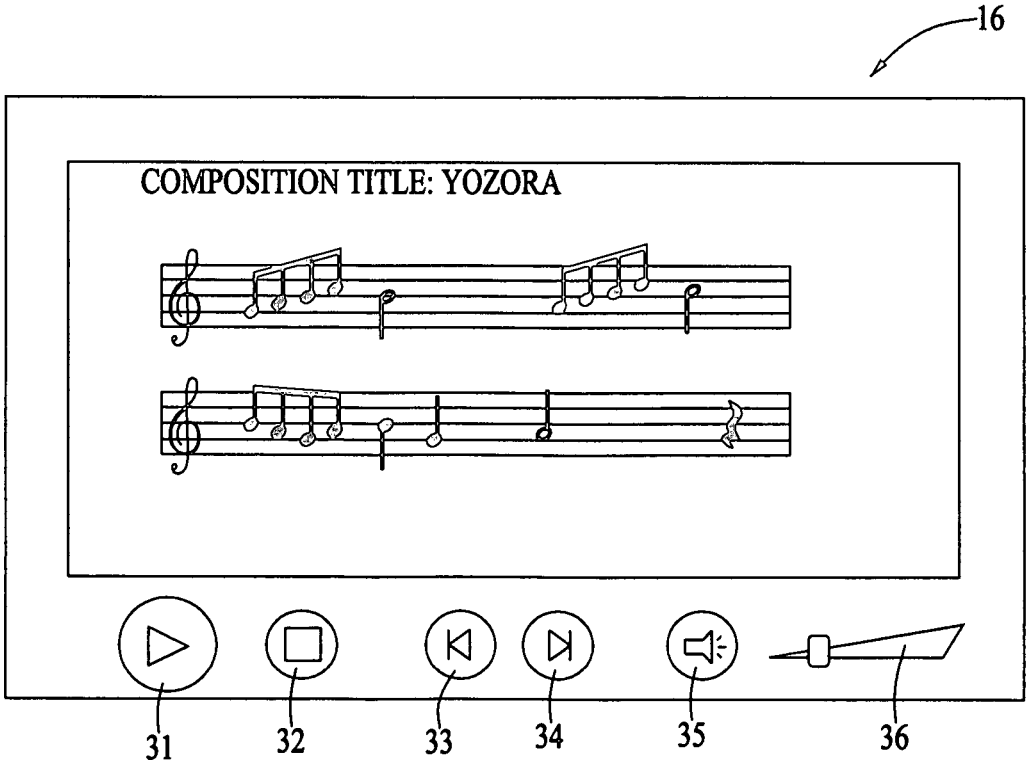

Next, an explanation will be given regarding the display screen that is displayed on the display device 16 of the PC 11 while referring to FIG. 2. The display screen is a screen that is displayed by the application program that controls a reproduction system connected externally via the USB interface 18. FIG. 2(*a*) shows the situation in which the composition title of the plurality of compositions that are stored on the CD is displayed in conformance with the track number.

A flexible disk, on which the SMF performance data is stored, is mounted in the flexible disk system of the electronic musical instrument 1. The PC 11 outputs a command requesting the composition title for each track, and the electronic musical instrument 1 outputs the composition title for each track that is stored on the flexible disk.

In FIG. 2(*a*), a plurality of icons for carrying out operations is displayed below the composition title, and it is possible to carry out various kinds of instructions by aligning the cursor on these icons and clicking the mouse.

The performance start icon 31 is an icon that instructs the performance to start, and it is possible to start the performance from the current stopped position. The performance stop icon 32 is an icon that instructs the performance to stop; and when this icon is clicked on during a performance, the performance is stopped at that point.

The beginning position instruction icon 33 is an icon that instructs the performance position to move to the start position of the current track, and the next track instruction icon 34 is an icon that instructs the performance position to move to the beginning position of the track following the current track. In those cases where the performance start icon 31, the performance stop icon 32, the beginning position instruction icon 33, or the next track instruction icon 34 has been operated, an instruction that corresponds to the requested operation is output from the USB interface 18.

When the mute icon 35 is clicked, the volume of the musical tone that is being generated is set to 0 while the performance continues on; and, when the mute icon 35 is clicked again, the volume is restored to the volume set by the volume icon 36. The volume icon 36 is an icon which can be used to adjust the volume of the musical tone being reproduced by dragging the operating knob. An operation of the mute icon 35 or the volume icon 36 changes the volume of the musical tone that is output by the PC 11, hence an instruction is not transmitted from the PC 11 to the external device.

FIG. 2(*b*) shows the musical score displayed in the display area in those cases where a performance has been started. When the performance is started, the electronic musical instrument 1 formulates a draw command that draws, for example, the musical score for two bars (as image data) and transmits this to the PC 11. The PC 11 carries out the display based on the draw command.

Incidentally, when the PC 11 is connected to a drive with which data can be written to a recordable CD or DVD disk, it is possible, by using of an application program, to also write in a specified format any musical tone data or image data desired that have been stored on the hard disk 17.

Figure 3:
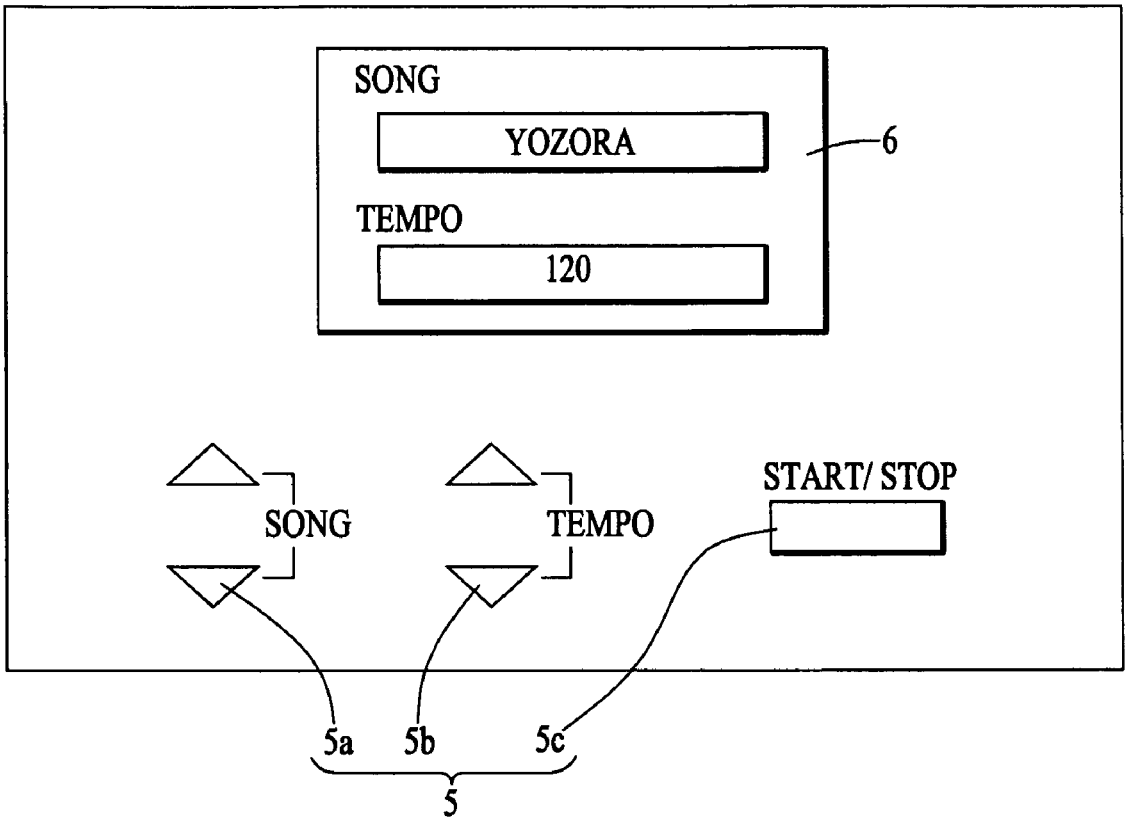
FIG. 3 is a drawing that illustrates an operating panel of an electronic musical instrument according to a preferred embodiment of the present invention.

Next, an explanation will be given regarding the operators 5 and the display device 6 of the electronic musical instrument 1 while referring to FIG. 3.

The operators 5 comprise song selection buttons 5*a* that enable the selection of the composition (the song) for the automatic performance, tempo setting buttons 5*b* that set the tempo value of the automatic performance, and start/stop button 5*c* that instructs the starting or stopping of the automatic performance of the selected composition. For the current preferred embodiment, specific shapes and arrangements of the buttons of the operators 5 are described as an example. However, other embodiments can utilize different shapes and arrangements of buttons that perform substantially similar functions to the buttons described below.

The song selection buttons 5*a* comprise the an equilateral triangularly shaped first button pointing upward, and an equilateral triangularly shaped second button pointing downward. Each time that the first button is operated, the compositions that have been stored in order on the flexible disk mounted in the flexible disk drive 7 is selected successively in ascending order. Similarly, the compositions can be successively selected in descending order by the operation of the second button.

The tempo setting buttons 5*b*, in the same manner as the song selection buttons 5*a*, comprise an equilateral triangularly shaped first button pointing upward, and an equilateral triangularly shaped second button pointing downward. Each time that the first button is operated, the tempo value is increased; and, each time the second button is operated, the tempo value is decreased.

The start/stop button 5*c* is a rectangular shaped button. In those cases where the button has been operated when the automatic performance is stopped, the automatic performance is started; and, in those cases where the button has been operated when an automatic performance is being carried out, the automatic performance is stopped.

The song selection buttons 5*a*, the tempo setting buttons 5*b*, and the start/stop button 5*c* are ignored in those cases where the start of the performance has been instructed by the PC 11 and the PC 11 instruction has precedence.

The display device 6 comprises a liquid crystal display (LCD) that displays the title of the composition that has been selected by the song selections buttons 5*a* or by the PC 11 as well as the value of the tempo that has been set by the tempo setting buttons 5*b*. In FIG. 3, the composition title of "Yozora" and the tempo value of "120" are displayed as an example.

Figure 4:
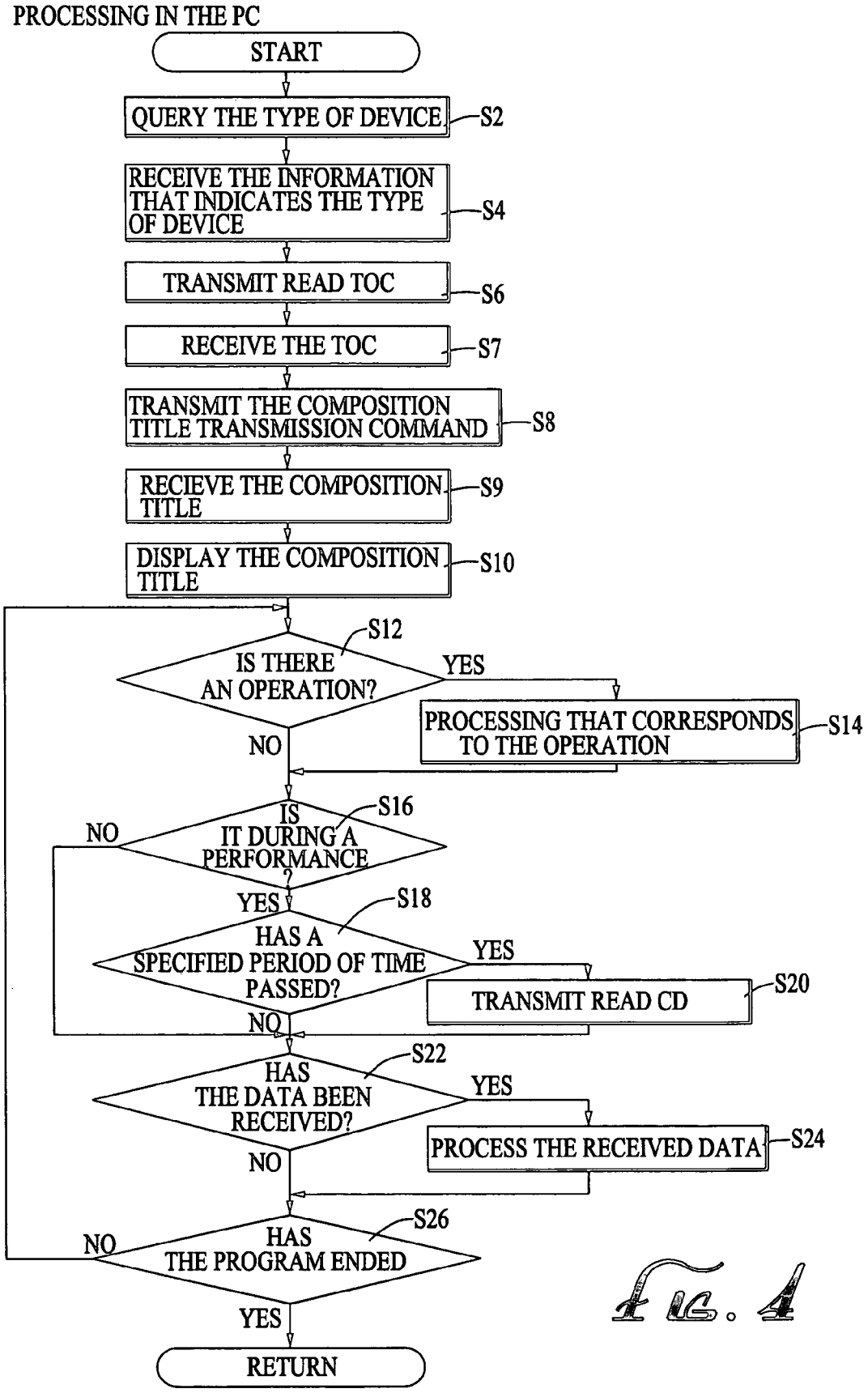
FIG. 4 is a flowchart that shows processing steps of a CPU of a personal computer (PC) according to a preferred embodiment of the present invention.

FIG. 4 is a flowchart that shows the processing steps executed by the CPU 12 of the PC 11. These processing steps are executed continuously from the launching of the application program that controls the device that reproduces a media such as a CD until the termination of such program. First, a command that queries the type of device and the type of media that is to be reproduced by the device is transmitted to the devices connected to the USB interface 18 (S2). Next, the PC 11 receives the information that indicates the type of device and the type of media that is to be reproduced from the device connected to USB interface 18 (S4). With the actual USB standard, a more complicated information exchange is carried out. However, in order to simplify the explanation here and to provide an example, the response sent by the electronic musical instrument 1 to the PC 11 is that the type of device is a CD drive device and the type of media is a CD-G media. The CD-G (also known as CD Graphics) is a CD standard that uses the physical structure of a CD for music but also allows a command for the display of static images has been stored in the sub-code region. In various other embodiments of the present invention, the device type of other removable media drives (such as a DVD drive) can be transmitted as the response from the electronic musical instrument 1 to the PC 11, and other corresponding media (such as DVD) can also be transmitted as the media type.

Next, the PC 11 transmits a Read TOC command to the connected device (S6). If the device is a CD drive reproducing a CD, since the TOC is stored in a specified region of the CD, the stored TOC is read out and transmitted via the USB interface. In the current embodiment, since the electronic musical instrument 1 has not stored the TOC itself, the TOC is generated by the electronic musical instrument 1 and transmitted. Details of the TOC generation are discussed below, while referring to FIG. 5.

The PC 11 receives the TOC (S7) and then transmits a composition title transmission command that requests the transmission of the titles of the compositions of each track stored on the CD (S8). The electronic musical instrument 1 transmits the title of each composition is stored on the flexible disk and the PC 11 receives the compositions titles (S9) and displays the composition titles on the display device 16 (S10; refer to FIG. 2(*a*)). With the SMF format, the composition titles are stored in each file and the compositions are not referred to as tracks.

Next, a determination is made as to whether or not the mouse has been operated in the display screen of the display device 16 (S12). In those cases where an operation has been made (S12: yes), processing is carried out in conformance with the operation (S14). As processing in conformance with an operation, there is the specification of the performance start position of a composition in the case where the mouse cursor has moved to and clicked on any of the plurality of composition titles that are displayed on the display device 16. In addition, in the case where the performance start icon 31 has been clicked on while the performance is stopped, a Read CD command is transmitted such that the performance is started from the beginning position of the composition that is selected and the performance flag is set.

The performance flag is stored in the RAM 14 and is a flag that indicates whether or not reproduction is being done. In those cases where an instruction has been made so that the reproduction of a CD is started, the flag is set and in those cases where an instruction has been made so that the reproduction of the CD is stopped, the flag is reset. Also, in those cases where an application has been launched, the flag is reset.

In addition, the performance flag is reset in those cases where the performance stop icon has been clicked during a performance. In those cases where the beginning position instruction icon 33 has been clicked on, the performance position is set to the beginning position of the composition that is selected; and, in those cases where the next track instruction icon 34 has been clicked on, the performance position is set to the beginning position of the next composition.

In addition, in those cases where the mute icon 35 is clicked on, the volume of the musical tone that is output to the D/A converter when a musical tone is generated is set to 0; and, when the mute icon 35 is clicked on a second time, the volume of the musical tone is restored to the volume set by the volume icon 36.

Next, a determination is made as to whether or not the performance flag is set (S16). In those cases where the performance flag is set (S16: yes), a determination is made as to whether or not a specified period of time has passed (S18). In those cases where a determination has been made that a specified period of time has passed (S18: yes), the PC 11 transmits a command to the connected device that instructs the readout of the block that follows the block of the previous transmitted Read CD command.

The data on a CD are stored in block units called frames, and each frame comprises data, parity, and the like. The device that reproduces the CD receives a Read CD command that instructs the readout in frame units from the PC 11, and the device carries out the readout based on the Read CD command. The Read CD command contains data that indicate the address that points to the CD reproduction position and the number of blocks that are to be read out following that address.

Next, a determination is made as to whether or not the data have been received via the USB interface 18 (S22). In those cases where the data have been received (S22: yes), the data received are then processed (S24). In those cases where audio data have been received, the audio data are transmitted to the D/A converter 20 and stored on the hard disk 17.

In those cases where in the determination processing of S22, a determination has been made that the data have not been received (S22: no), or following the processing of S24, a determination is made as to whether or not an icon not shown in the drawing has been operated to instruct the termination of the application program has been instructed (S26). In those cases where the termination has been instructed (S26: yes), the application program is terminated. In those cases where the termination has not been instruction (S26: no), the routine returns to the processing of S12.

Figure 5:
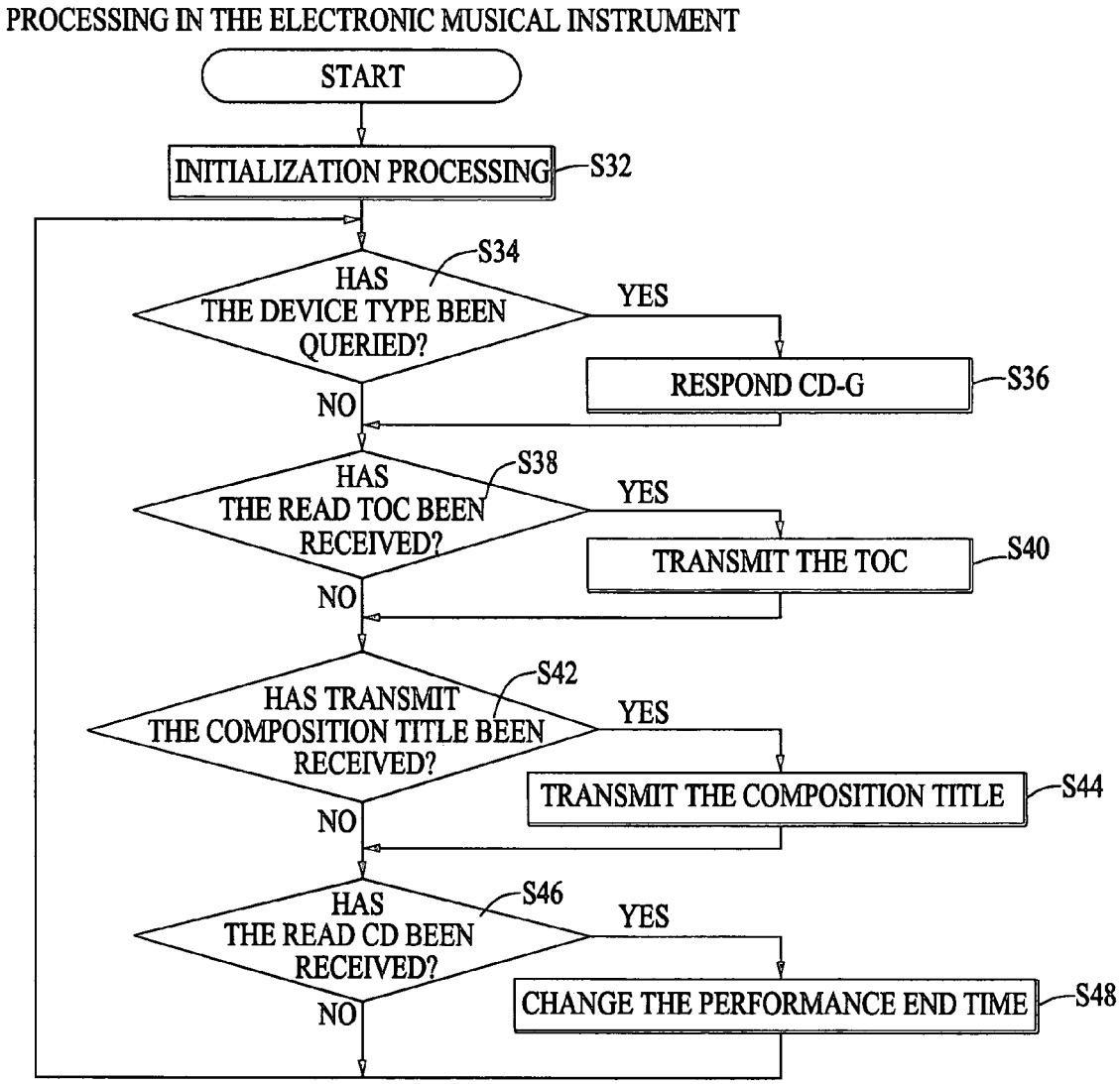
FIG. 5 is a flowchart that shows processing steps executed by a CPU of an electronic musical instrument according to a preferred embodiment of the present invention.

Next, an explanation will be given regarding the processing that is carried out by the CPU 2 of the electronic musical instrument 1 while referring to FIG. 5. FIG. 5 is a flowchart that shows the main processing executed by the CPU 2 launched by turning on the power to the electronic musical instrument 1 and continuously carried out until the power is turned off. In order to simplify the explanation, the flowchart of FIG. 5 omits the processing performed in those cases where a reproduction instruction is not received from the PC 11, the operators 5 of the electronic musical instrument 1 are detected and processing is carried out in conformance with their operation.

First, the initialization processing is carried out (S32). For the initialization processing, there is the processing that displays a specified initial screen on the display device 6 and the like. Next, a determination is made as to whether or not a command that queries the type of device and the type of media that is to be reproduced by the device has been received via the USB interface 8 (S34). In those cases where a determination has been made that a command that queries the type of device and the type of media has been received (S34: yes), the electronic musical instrument 1 transmits a response that the type of device is a CD drive device and the type of media to be reproduced is a CD-G (S36).

In those cases where a determination has been made in the processing of S34 that a query command has not been received (S34: no) or a response has already been transmitted, the CPU 2 next determines whether or not a Read TOC command has been received via the USB interface 8 (S38).

In those cases where a determination has been made that a Read TOC command has been received (S38: yes), a TOC is formed from the performance data stored on the flexible disk mounted in the flexible disk device 7 and then transmitted to the PC 11 (S40).

Since the performance time for each composition is not stored in the performance data stipulated by the SMF, the performance time must be calculated for each composition. Under the SMF format, the time from the event that is immediately prior to each event is stored in the performance data as units of time that are called ticks (the period of time in which the time of one beat has been divided by a specified number, for example, 96), it is possible to add the ticks up and calculate the performance time from the value of the tempo and the number of ticks. In this manner, the performance time of each composition stored on the flexible disk is derived and used to form a TOC, which lists the performance time corresponding to the track number. The TOC is then transmitted to the PC 11.

In those cases where during the processing of S38, it has been determined that a Read TOC command has not been received (S38: no) or that the TOC has already been transmitted, a determination is next made as to whether or not a composition title transmit command has been received (S42).

In those cases where a determination has been made that a composition title transmit command has been transmitted (S42: yes), each of the composition titles that are stored on the flexible disk mounted in the flexible disk device 7 is transmitted to the PC 11 (S44). In those cases where in the processing of S42, a determination has been made that a composition title transmit command has not been received (S42: no) or that the composition title has already been transmitted, a determination is next made as to whether or not a Read CD command has been received (S46). In those cases where a Read CD command has been received (S46: yes), a determination is made from the address information that is stored in the Read CD command to determine which composition the command applies. In those cases where a performance has not been started, an instruction is made to start the performance of that composition. Together with this, the performance end time that indicates the time of the end of the performance is stored in the RAM 4 based on the block count that is stored in the Read CD command. In those cases where an automatic performance has already been started and, following the Read CD command that has been received before, there is a performance instruction, the performance end time that has been stored in the RAM 4 based on the block count that has been stored in the Read CD command is changed (S48).

In those cases where a determination has been made in the processing of S46 that a Read CD command has not been received (S46: no) or in those cases where the performance time has been changed in the processing of S48, the routine returns to the processing of S34 and following that, the same processing is repeated.

Next, an explanation will be given regarding the automatic performance processing while referring to FIGS. 6 and 7. FIG. 6 is a drawing that illustrates the performance data. The performance data are stored in a sequence that corresponds to the time from the preceding event and the type of event. The event is a MIDI message that is prescribed in accordance with the MIDI standard. The program change sets the timbre and the like; the control change sets the volume; the note ON instructs the start of the tone generation; and, the note OFF instructs the end of the tone generation.

In the example shown in FIG. 6, the first set of data is set at time 0 and a program change is stored as the MIDI message. Accordingly, the program change is sent to the sound source 9 at the same time as the start of the performance. When the sound source 9 receives the program change, the timbre of the musical tone that is formed is set to the timbre stipulated by the program change.

In the second set of data, the time is set to 0 and a note ON is stored as the MIDI message. The note ON is sent to the sound source 9 at the same time as the start of the performance. When the sound source 9 receives the note ON, the generation of the musical tone having the pitch stipulated by the note ON is started at the volume that corresponds to the velocity (the key pressing speed) stipulated by the note ON.

In the third set of data, the time is set to 24 and a note ON is stored as the MIDI message. Accordingly, after the MIDI message of the second set of data has been transmitted to the sound source 9, the note ON of the third set of data is sent to the sound source 9 24 ticks later. In the same manner, in the fourth set of data, the time is set to 1 and a note OFF is stored as the MIDI message. Accordingly, after the MIDI message of the third set of data has been transmitted to the sound source 9, the note OFF of the fourth set of data is sent to the sound source 9 one tick later. When the sound source 9 receives the note OFF, control is implemented so that the generation of the musical tone having the pitch that is stipulated by the note OFF ends. Incidentally, the data that indicate the lyrics are also stored as performance data.

Figure 7:
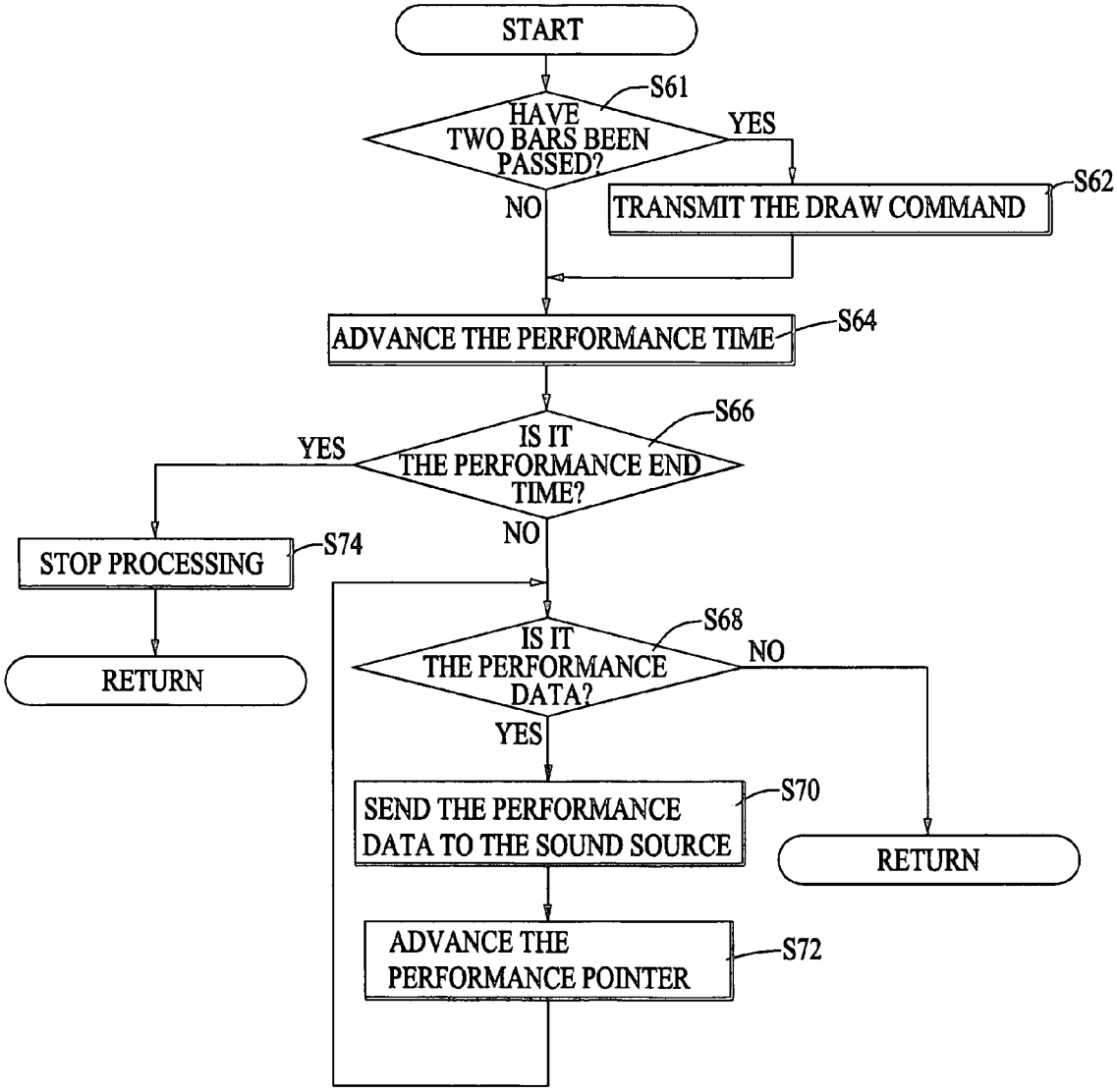
FIG. 7 is a flowchart that shows automatic performance processing.

FIG. 7 is a flowchart that shows the automatic performance processing, which is launched by a timer interrupt that is generated at a time interval corresponding to the tempo. First, a determination is made as to whether or not the automatic performance has passed through two bars following the transmission of a draw command for the formation of the musical score the previous time (S61). In this automatic performance processing, as is shown in FIG. 2(*b*), a draw command for the reading out of the performance data and the display of four bars of the musical score is formed and transmitted to the PC 11. For the musical score, the pitch is determined from the note ON of the performance data, and the note length is determined from the time of the start of the tone generation of that pitch until the termination. The notes are displayed on a five line staff score and, together with this, in those cases where the lyrics have been stored, the corresponding lyrics can also be displayed.

In those cases where the performance has been started from the beginning of the composition, a draw command for the display of four bars of the musical score from the beginning of the composition is transmitted to the PC 11. A draw command is transmitted to the PC 11 for the display of four bars of the musical score for each two bars that the automatic performance advances from that point in the performance.

Accordingly, in those cases where two bars have been passed through (S61: yes), a draw command for the display of the musical score for up to four bars from that point is formed and transmitted to the PC 11 (S62). In those cases where two bars have not been passed through (S61: no) or in those cases where a draw command for the display of the musical score has already been transmitted to the PC 11 in the processing of S62, the performance time is advanced (S64).

Next, a determination is made as to whether or not the performance time has reached the performance end time that is set by the Read CD command (S66). In those cases where a determination has been made that the performance time has not reached the performance end time (S66: no), a determination is made as to whether the time following the transmission of the performance data to the sound source 9 the previous time has reached the time of the performance data that is indicated by the current pointer (S68). In those cases where a determination has been made that the current time has reached the time of the current data (S68: yes), the performance data are transmitted to the sound source 9 (S70), the pointer advances to the following performance data (S72), and the routine returns to the processing of S68. In those cases where a determination has been made in the determination processing of S68 that the current time has not reached the time of the performance data (S68: no), the routine returns to the main processing.

In those cases where in the processing of S66, the performance has reached the performance end time (S66: yes), the processing that stops the automatic performance is carried out (S74) and the routine returns to the main processing from the automatic performance processing. The processing that stops the automatic performance is processing that is done so that a timer interrupt is not generated.

When the performance data are input to the sound source 9 in the automatic performance processing, the sound source 9 carries out the generation of musical tone data and the like in conformance with the performance data. The performance data that have been generated by the sound source 9 are temporarily stored in the RAM 4 and output in a specified data format in conformance with the USB interface 8 requests.

As explained above, in those cases where the electronic musical instrument 1 has received a query from the PC 11 regarding the type of media that is to be reproduced, and in those cases where the electronic musical instrument 1 responds that the type is a CD-G and, together with this, has received a command that instructs the reproduction of the CD-G, musical tone data and draw commands are transmitted in a format that is the same as in the case in which the CD-G is reproduced. Therefore, there is no need for the transmission and reception of special commands and messages by the PC 11 in order to communicate with the electronic musical instrument 1. Accordingly, it is possible to receive musical tone and image data from the electronic musical instrument with software for the reproduction of media other than that in the electronic musical instrument, such as software for the reproduction of CD that is likely already installed on the PC 11.

Incidentally, the processing of the flowchart cited in FIG. 7 is applicable to the automatic performance means of the preferred embodiment, the processing of S42 in the flowchart cited in FIG. 5 is applicable to the input means, and the processing of S68 and S70 in the flowchart cited in FIG. 7 is applicable to the control means.

An explanation was given above regarding the present invention based on a preferred embodiment. However, the present invention is not in any way limited to the preferred embodiment that has been discussed above, and the possibility of various modifications and changes that do not diverge from and are within the scope of the tenor and purport of the present invention can be easily surmised.

For example, in the preferred embodiment described above, the electronic musical instrument 1 transmits to the PC 11 information that the media to be reproduced is a CD-G and, and transmits the musical tone data and the static images with the draw command for the display of the musical score. However, it can also be arranged such that the electronic music instrument 1 transmits to the PC 11 information that the media to be reproduced is a DVD; and, in that case, it may be set up such that image data showing moving images are transmitted to the PC 11 together with the musical tone data. With a moving image, it is possible for the performance position to be matched to the progression of the performance to be displayed on the musical score or for an image, the movement of which is coordinated with the rhythm, to be displayed. Incidentally, since if the media are different, the respective formats for the transmission and reception of musical tone data and image data are different, the musical tone data and the image are transmitted to the PC 11 in a format that corresponds to the type of media.

In addition, the musical tone data may also be stored and transferred compressed as MP3 or MPEG4 and may also be converted to a data format having a particular sampling frequency at the time of transfer or a bit count.

Furthermore, in the preferred embodiment described above, an example was given of the musical score as static data but it may also be an illustration of a musical instrument that corresponds to the musical tones that are performed or text that is related to the composition such as, for example, the lyrics and the like.

In addition, in the preferred embodiment described above, it has been set up such that the PC 11 acquires the composition title that is stored on the media from the electronic musical instrument 1. However, it may also be set up such that the PC 11 accesses a CD database via the Internet and acquires the composition title based on the TOC.

Also, in the preferred embodiment described above, it has been set up such that the automatic performance processing carries out the performance at a speed that corresponds to the tempo. However, it may also be set up such that the data that are output are formed at a high speed and transmitted without regard to the speed that corresponds to the tempo.

What is claimed is:

1. An electronic musical instrument, comprising:

storage means for storing performance data that comprises at least one composition, the performance data of at least one composition comprising at least one tick and a tempo;

musical tone generation means for generating musical tone data in conformance with the performance data;

automatic performance means for reading out the performance data stored in the storage means at a time in conformance with the time information and for supplying the performance data to the tone generation means;

communications means for communicating with external devices, input means for inputting control data, said control data requesting the musical tone data via the communications means from a media on which the musical tone data have been stored such that the music tone data are reproduced, said music tone data sampled at a specified sampling frequency;

control means for controlling the musical tone generation means in conformance with the control data input in the input means, in accordance with the performance data stored in the storage means, and by means of the automatic performance means, in the generation of the musical tone data; and performance time means for generating the performance time of the at least one composition using the tempo and a total number of ticks;

transmission means for transmitting the musical tone data generated by the musical tone generation means and the performance time via the communications means;

wherein the musical tone data transmitted is in a data format consistent with a digital audio data format of musical tone data transmitted from a removable media drive, such that the removable media drive is emulated by the electronic musical instrument.

2. The electronic musical instrument according to claim 1, wherein:

the automatic performance means forms image data based on the performance data, and the transmission means outputs the image data formed by the automatic performance means and the music tone data formed by the music tone generation means via the communications means.

3. The electronic musical instrument according to claim 2, wherein the automatic performance means forms the image data to display a musical score based on the performance data stored in the storage means.

4. The electronic musical instrument according to claim 3, wherein:

the storage means also stores lyrics, and the automatic performance means forms the image data to display the lyrics stored in the storage means.

5. The electronic musical instrument according to claim 2, wherein:

the storage means also stores lyrics, and the automatic performance means forms the image data to display the lyrics stored in the storage means.

6. The electronic musical instrument according to claim 1, wherein the musical tone data transmitted comprises audio signals.

7. The electronic musical instrument according to claim 1, wherein the removable media drive is a CD drive or a DVD drive.

8. The electronic musical instrument according to claim 1, wherein the musical tone data transmitted is converted to an analog signal, amplified and emitted by a speaker.

9. The electronic musical instrument according to claim 1, wherein the musical tone data transmitted is compressed as MP3 or MPEG4 format.

10. The electronic musical instrument according to claim 1, wherein the musical tone data transmitted is in a data format having a particular sampling frequency or bit count at the time of transfer.

11. The electronic musical instrument according to claim 1, wherein the data format of the musical tone data transmitted by the transmissions means is one of a CD standard and a DVD standard.

12. The electronic musical instrument according to claim 11, wherein the CD standard is CD Graphics (CD-G).

13. The electronic musical instrument according to claim 1, wherein the communication means for communicating with external devices is configured to provide to one of the external devices data identifying a type of the removable media drive, in response to a request by the one of the external devices for the type of the removable media drive.

14. An electronic musical instrument, comprising:

a storage device for storing performance data that comprises at least one composition, the performance data of at least one composition comprising at least one tick and a tempo;

musical tone generator for generating musical tone data in conformance with the performance data;

a processor controlled for reading out the performance data stored in the storage device at a time in conformance with the time information and for supplying the performance data to the musical tone generator;

a communications link for communication connection with external devices, an input device for inputting control data, said control data requesting the musical tone data via the communications link from a media on which the musical tone data have been stored, said music tone data sampled at a specified sampling frequency; and transmission electronics for transmitting the musical tone data generated by the musical tone generator via the communications link;

wherein the musical tone data transmitted is in a data format consistent with a digital audio data format of musical tone data transmitted from a removable media drive, such that the removable media drive is emulated by the electronic musical instrument; and wherein the processor is further controlled for controlling the musical tone generator in conformance with the control data input in the input device, in accordance with the performance data stored in the storage device, to generate the musical tone data;

wherein the processor is configured to generate the performance time of the at least one composition by using the tempo and a total number of ticks, wherein the performance time is transmitted from the electronic musical instrument.

15. The electronic musical instrument according to claim 14, wherein:

the processor is further controlled to form an image data based on the performance data, and the transmission electronics outputs the image data and the music tone data via the communications link.

16. The electronic musical instrument according to claim 15, wherein the processor is further controlled to form the image data to display a musical score based on the performance data stored in the storage device.

17. The electronic musical instrument according to claim 16, wherein:

the storage device also stores lyrics, and the processor is further controlled to form the image data by displaying lyrics stored in the storage means.

18. The electronic musical instrument according to claim 15, wherein:

the storage device also stores lyrics, and the processor is further controlled to form the image data by displaying lyrics stored in the storage means.

19. The electronic musical instrument according to claim 14, wherein the data format of the musical tone data transmitted by the transmission electronics is one of a CD standard and a DVD standard.

20. The electronic musical instrument according to claim 19, wherein the CD standard is CD Graphics (CD-G).

21. The electronic musical instrument of claim 14, wherein generating the performance time comprises dividing the total number of ticks by the tempo.

22. The electronic musical instrument of claim 14, wherein the at least one tick represents a period of time, wherein one beat includes a plurality of ticks.

23. An electronic musical instrument operable with a personal computer (PC), the electronic musical instrument comprising:

a processor, a data interface and a sound source for forming musical tone data in MIDI format;

wherein the processor is controlled such that upon an inquiry from a PC connected to the data interface for a device identity, the electronic music instrument responds via the data interface with the device identity of a removable media drive device that stores data associated with the musical tone data; and wherein the processor is controlled to transmit musical tone data through the data interface to the PC in response to commands sent from the PC for the removable media drive, said musical tone data is transmitted in a data format facilitating a reproduction of the musical tone data at the PC, wherein the reproduction of the musical tone data at the PC emulates a reproduction of musical tone data transmitted from the removable media drive;

wherein the data format facilitating the reproduction includes a table of content that comprises a performance time for each composition, a total number of ticks in the composition and a tempo of the composition used to calculate the performance time.

24. The electronic musical instrument according to claim 23, wherein the removable media drive of the device identity is located external to the electronic music instrument.

25. The electronic musical instrument according to claim 23, wherein the removable media drive is a CD drive or a DVD drive.

26. The electronic musical instrument according to claim 23, wherein the data interface is a USB interface.

27. The electronic musical instrument according to claim 23, the processor is controlled to transmit image data consistent with the data format of the removable media drive along with the music tone data.

28. The electronic musical instrument according to claim 27, wherein the image data comprises musical score images, said processor further controlled to process the music tone data to generate the image data comprising the musical score images corresponding to the music tone data.

29. The electronic musical instrument according to claim 28, wherein the image data further comprises lyrics stored in the storage device.

30. The electronic musical instrument according to claim 23, further comprising a storage device for storing music tone data, wherein the processor is further controlled, upon a Read TOC command received via the data interface, to process music tone data stored in the storage device to generate a table of contents (TOC) consistent with a TOC format of the removable media drive.

31. The electronic musical instrument according to claim 30, wherein the music tone data stored in the storage device is in a MIDI format, and the music tone data transmitted to the PC is in a PCM format.

32. A method for data communication, comprising:

providing a electronic music instrument connected to a personal computer (PC) via a data interface;

receiving by the electronic music instrument an inquiry from the PC for a device identity and a media identity;

transmitting from the electronic music instrument to the PC the device identity of a removable media drive and the media identity of a media corresponding to the removable media drive;

receiving by the electronic music instrument commands from the PC corresponding to a command format of the removable media drive; and transmitting music tone data from the electronic music instrument to the PC in a data format facilitating a reproduction of the musical tone data at the PC, wherein the reproduction of the musical tone data at the PC emulates a reproduction of musical tone data transmitted from the removable media drive;

wherein transmitting music tone data comprises generating the performance time of at least one composition by using the tempo and the total number of ticks of the composition.

33. The method of claim 32, wherein the removable media drive is a CD drive or a DVD drive, and the media is a CD, CD-G, or DVD.

34. The method of claim 32, further comprising the step of transmitting image data from the electronic music instrument to the PC in the data format of the removable media drive.

35. The method of claim 34, wherein the image data comprises music score images generated from the music tone data by electronic music instrument.

36. A method for operating an electronic musical instrument, comprising:

providing a storage device, processor and a tone generator on the electronic musical instrument;

storing performance data in the storage device, the performance data comprising at least one composition that includes at least one tick and a tempo;

generating, with the tone generator, musical tone data in conformance with the performance data;

controlling the processor to read out performance data stored in the storage device at a time in conformance with the time information and for supplying the performance data to the musical tone generator;

coupling a communications link for communication between the electronic musical instrument and external devices, inputting control data, the control data requesting the musical tone data via the communications link from a media on an external device on which the musical tone data have been stored, said music tone data sampled at a specified sampling frequency;

transmitting the musical tone data generated by the musical tone generator via the communications link wherein the musical tone data transmitted is in a data format consistent with a digital audio data format of musical tone data transmitted from a removable media drive, such that the removable media drive is emulated by the electronic musical instrument; and controlling the musical tone generator in conformance with the inputted control data, in accordance with the performance data stored in the storage device, to generate the musical tone data;

wherein transmitting music tone data comprises generating the performance time of the at least one composition by using the tempo and a total number of ticks of the at least one composition.

37. The method according to claim 36, further comprising:

controlling the processor to form an image data based on the performance data, and outputting image data and the music tone data via the communications link.

38. The method according to claim 37, further comprising controlling the processor to form the image data to display a musical score based on the performance data stored in the storage device.

39. The method according to claim 38, wherein the storage device also stores lyrics, and the method further comprises controlling the processor to form the image data by displaying lyrics stored in the storage means.

40. The method according to claim 37, wherein the storage device also stores lyrics and the method further comprises controlling the processor to form the image data by displaying lyrics stored in the storage means.

* * * * *